United States Patent [19]

Ryder

[11] 4,062,134

[45] Dec. 13, 1977

[54] TOE CLIP FOR SKI BOOTS

[76] Inventor: Gary R. Ryder, 663 Linda Ave., Salem, Oreg. 97303

[21] Appl. No.: 741,554

[22] Filed: Nov. 15, 1976

[51] Int. Cl.[2] ..... A43B 5/04; A43B 13/22

[52] U.S. Cl. ..... 36/132; 36/117; 36/73

[58] Field of Search ..... 36/72 R, 73, 75, 132, 36/136, 117

[56] References Cited

U.S. PATENT DOCUMENTS

| | | | |
|---|---|---|---|
| 1,245,647 | 11/1917 | Weinstein | 36/73 |
| 1,515,665 | 11/1924 | Eck | 36/132 |
| 1,659,524 | 2/1928 | Faulks | 36/73 |

*Primary Examiner*—Patrick D. Lawson
*Attorney, Agent, or Firm*—Eugene M. Eckelman

[57] ABSTRACT

A plate-like body member is arranged to be secured on the bottom of a boot sole over existing binding holes in the bottom surface of the boot sole which receive stabilizing pins on the ski. Apertures are provided in the body member in alignment with the binding holes in the ski boot to reinforce the binding holes against lateral wear. The body member has upturned tabs arranged to extend up the side edges and over the top of the sole. These tabs are secured to the sole by suitable fasteners. The body member has an elongated upturned tab at the front arranged to lie against the front edge of the boot sole for further stability.

5 Claims, 4 Drawing Figures

FIG. 1
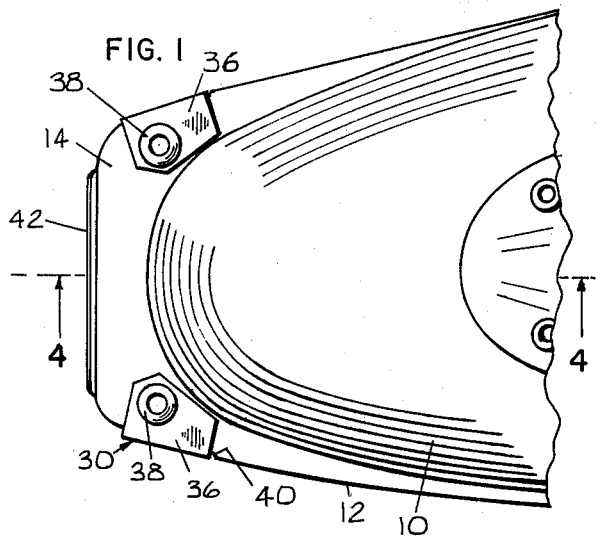
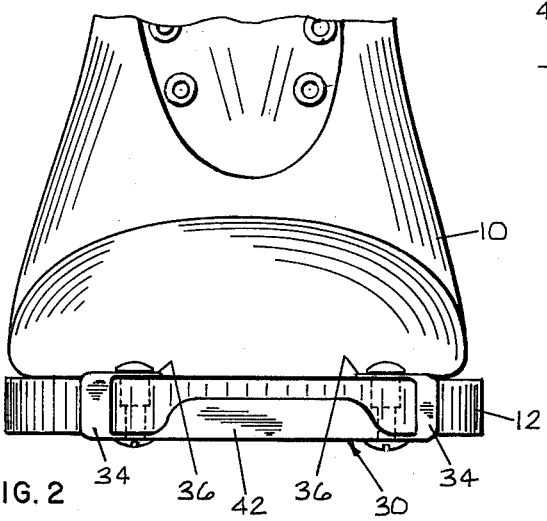
FIG. 2
FIG. 3
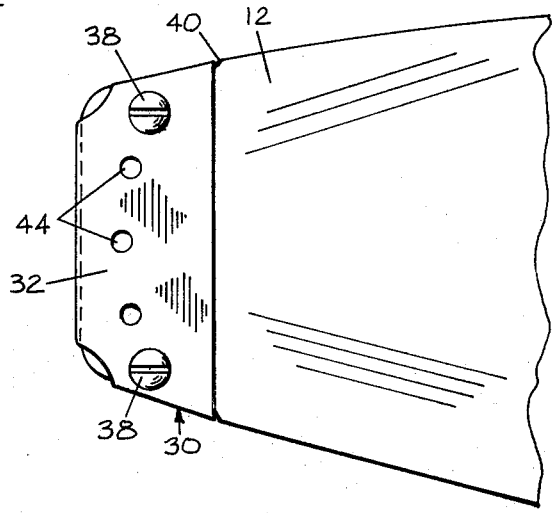
FIG. 4
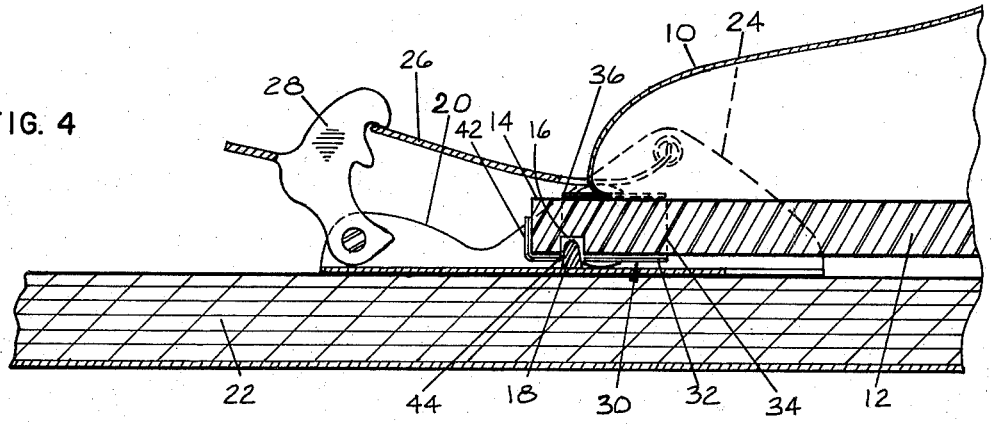

TOE CLIP FOR SKI BOOTS

BACKGROUND OF THE INVENTION

This invention relates to a new and novel toe clip for ski boots.

In some types of ski bindings, such as bindings for cross country skis, ski boots therefor are provided with binding holes arranged to receive stabilizing pins integral with the ski. Clamps are then provided to hold the boot on the ski at the front so that a good maneuvering connection is provided between the front of the ski boot and the ski. In such a ski binding arrangement, the binding holes in the boot become enlarged after only a short period of use whereby a good maneuvering connection is lost between the boot and the ski. It is then necessary to resole the boot or purchase a new pair of boots.

SUMMARY OF THE INVENTION

According to the present invention and forming a primary objective thereof, a toe clip which is adaptable for securement to ski boots is arranged to provide reinforcement for the binding holes and thus provide a long lasting, efficient connection between a boot and a ski.

To carry out such objectives, a plate-like body member is provided which is arranged to be secured along a surface of the sole of a boot adjacent the front and over the binding holes. The body member is provided with apertures arranged to be aligned with the binding holes for reinforcing the latter against lateral wear. Means for securing the body member on a sole comprise side tabs which are secured to the sole and an elongated front tab that abuts against the front of the sole.

The invention will be better understood and additional objects and advantages will become apparent from the following description taken in connection with the accompanying drawings.

BRIEF DESCRIPTION OF THE DRAWINGS

FIG. 1 is a fragmentary top plan view showing a ski boot with the present toe clip secured thereon;

FIG. 2 is a fragmentary from elevational view of a ski boot with the toe clip thereon;

FIG. 3 is a fragmentary bottom plan view of a ski boot with the toe clip thereon; and FIG. 4 is a longitudinal sectional view taken on the line 4—4 of FIG. 1, this view showing the boot attached to a ski.

DETAILED DESCRIPTION OF A PREFERRED EMBODIMENT

With particular reference to the drawings, the numeral 10 designates a ski boot of a type which is in conventional use. Such a ski boot has a heavy sole 12 which projects forward of the boot in an extended portion 14. The bottom surface of the sole has one or more binding holes 16, FIG. 4, which receive stabilizing pins 18 integral with a ski binding 20 of a conventional construction secured to the top surface of a ski 22. The ski binding 20 has upstanding side flanges 24 which rotatably support a bifurcated clamp plate 26 arranged to be releasably secured in a downward binding position on the projecting sides of the sole by a toothed catch 28.

The type of boot shown and ski binding therefor are adaptable particularly for use with cross country skis wherein the boot is only held on the ski at its front end as shown, leaving the back of the boot free to move up and down relative to the ski as desired in cross country skiing.

The binding holes become enlarged due mainly to the fact that the skier does not have the boot positioned properly into the binding while clamping the boot onto the binding. This forces the pins to make their own holes, thus the hole enlargement. The present toe clip which provides proper attachment of the boot onto the binding and also reinforecement for the connection between the stabilizing pins and the binding holes, is designated by the numeral 30.

Such toe clip comprises a plate-like body member 32 which extends the full width of the boot sole at the toe end and rearwardly a substantial distance past the binding holes 16. The body member 32 has a pair of upstanding tabs 34 one on each side, and these tabs have a top inwardly extending portion 36 which lies flat on the top surface of the sole at the extended portion 14 of the latter. Fasteners 38, such as rivents, extend through the top portions 36 of the side tabs, through the top portions 36 of the side tabs, through the sole, and through the body member 32. Such provides an integral and stable connection of the toe plate on the sole. If desired, the side edges of the sole 12 may be notched, for example at 40, to receive the side tabs 34 so that the tabs will be flush with the outside edge of the sole.

The front of the body member 32 has an upturned tab 42 adapted to lie along the front edge of the sole 12 in abutment therewith. This tab extends upwardly to a point just below the top of the sole and is elongated so as to engage a substantial distance, for example two inches, across the front edge of the sole and assist in the maneuvering connection, along with the other fastening means, between the toe clip and the sole. The tab 42 also adds strength to the clip and helps to maintain a flat plane condition for the bottom of the clip.

The body member 32 is provided with apertures 44 selectively positioned such that in the installed position of the toe clip, these apertures align with the binding holes 16. The apertures 44 are of a size so as to have a rather close fit over the stabilizing pins 18 to provide a firm connection between the boot and the ski. The toe clip of the invention may be utilized with new boots to prevent wear of the binding holes 16 or such clip may be utilized to restore boots in which the binding holes 16 have been enlarged from wear. The clip, in properly positioning the boot on the binding, prevents enlargement of the binding holes 16 so as to provide long life for the ski boots. A good maneuvering connection is also always present between the boot and the ski.

The body member 32 can be formed of a bendable material such as sheet metal whereby with a minimum of instructions and everyday tools, a blank with the side and front tabs formed flat in the blank can be bent for installation by the consumer. Or, of course, for boots which have a uniform sole size and shape, the clip could be of premolded metal or other material.

It is to be understood that the form of my invention herein shown and described is to be taken as a preferred example of the same and that various changes in the shape, size and arrangement of parts may be resorted to without departing from the spirit of my invention, or the scope of the subjoined claims. For example, some boots have holes in the top of the extended part 14 of the sole, and the present clip could be adapted to such structure.

Having thus described my invention, I claim:

1. A toe clip arranged for use with a ski boot of the type having a sole with opposite surfaces and which projects beyond the boot at a front portion of the boot, the sole having at least one binding hole in a surface thereof adjacent the front for receiving a stabilizing pin integral with a ski binding, said toe clip comprising a. a plate-like body member arranged to lie flat along a surface of the sole of a boot adjacent the front and over the binding hole which receives a stabilizing pin, b. means arranged to secure said body member on a ski boot, c. and means defining an aperture in said body member arranged to be aligned with a binding hole in the sole of a ski boot upon securement of said body member on a boot whereby said toe clip is arranged to reinforce the binding hole against lateral wear resulting from connection between a ski binding and the boot.

2. The toe clip of claim 1 wherein said means arranged to secure said body member on a boot comprises a pair of side tabs extending at substantially right angles therefrom and arranged also to extend along an opposite surface of the sole, and fastening means arranged to secure said tabs to the sole of a boot.

3. The toe clip of claim 1 wherein said means arranged to secure said body member on a boot comprises a pair of side tabs extending at substantially right angles therefrom and arranged also to extend along an opposite surface of a sole, fastening means arranged to secure said tabs to the sole of a boot, and an elongated third tab on said body member extending at substantially right angles therefrom and arranged to abut against the front edge of the sole of a boot.

4. The toe clip of claim 1 including at least two of said apertures in said body member arranged to be aligned with a corresponding number of binding holes in the sole of a ski boot.

5. A toe clip arranged for use with a ski boot of the type having a sole which projects beyond the boot at a front portion of the boot and which has at least one binding hole in the bottom surface thereof adjacent the front for receiving a stabilizing pin integral with a ski binding, said toe clip comprising:

a. a plate-like blank of bendable material comprising a body member arranged to lie flat along the bottom surface of the sole of a boot adjacent the front and over the binding hole which receives a stabilizing pin, b. a pair of side tabs on said blank arranged to be bent upwardly and also arranged to extend over a top portion of a sole, c. fastening means arranged to secure said tabs to the sole of a boot, d. and means defining an aperture in said body member arranged to be aligned with a binding hole in the sole of a ski boot upon securement of said body member on a boot whereby said toe clip is arranged to reinforce the binding hole against lateral wear resulting from a connection between a ski binding and the boot.

* * * * *